United States Patent [19]

Cole et al.

[11] 4,393,640

[45] Jul. 19, 1983

[54] METHOD AND APPARATUS FOR HANDLING AND FILLING BAGS OR ENVELOPES

[75] Inventors: Denis B. Cole, Honiton; Derek C. Trethewy, Esher, both of England

[73] Assignee: Hazelwood Enterprises Limited, Alderney, Channel Islands

[21] Appl. No.: 182,182

[22] Filed: Aug. 28, 1980

[51] Int. Cl.[3] ..... B65B 9/08; B65B 43/30; B65B 43/36

[52] U.S. Cl. ..... 53/69; 53/385; 53/386; 53/391; 493/188

[58] Field of Search ..... 53/385, 386, 384, 390, 53/391, 381 R, 69, 67; 493/188, 11

[56] References Cited

U.S. PATENT DOCUMENTS

| | | | |
|---|---|---|---|
| 3,206,913 | 9/1965 | Fleigher et al. | 53/385 X |
| 3,298,156 | 1/1967 | Lerner | 53/385 X |
| 3,298,580 | 1/1967 | Lerner | 225/106 |
| 3,331,182 | 7/1967 | Hannon | 53/385 X |
| 3,500,726 | 3/1970 | Lense | 493/11 |
| 3,527,021 | 9/1970 | Pitts, Jr. et al. | 53/385 |
| 3,568,400 | 3/1971 | Pitts | 53/385 X |
| 3,579,948 | 5/1971 | Lerner | 53/385 X |
| 3,619,969 | 11/1971 | Holcombe | 53/29 |
| 3,908,343 | 9/1975 | Farrelly | 53/385 |
| 3,994,209 | 11/1976 | Jacob | 493/188 X |
| 4,241,562 | 12/1980 | Meyer | 53/385 X |

FOREIGN PATENT DOCUMENTS

| | | |
|---|---|---|
| 1367081 | 6/1964 | France . |
| 958265 | 5/1964 | United Kingdom . |
| 1075713 | 7/1967 | United Kingdom . |
| 1196773 | 7/1970 | United Kingdom . |
| 1240372 | 7/1971 | United Kingdom . |
| 1303310 | 1/1973 | United Kingdom . |

OTHER PUBLICATIONS

*Polylope,* Bulletin of Polylope Limited, The Stable House, Lammas Lane, Esher, Surrey KT10 8PN.

*Primary Examiner*—James F. Coan
*Attorney, Agent, or Firm*—Sughrue, Mion, Zinn, Macpeak & Seas

[57] ABSTRACT

A method and apparatus for handling and filling bags or envelopes fed from a continuous length supply are disclosed wherein each bag or envelope is open at or adjacent one marginal edge of the continuous length supply for insertion thereinto of filling material.

17 Claims, 5 Drawing Figures

METHOD AND APPARATUS FOR HANDLING AND FILLING BAGS OR ENVELOPES

FIELD OF THE INVENTION

This invention is concerned with the handling of bags or envelopes.

BACKGROUND OF THE INVENTION

Modern retailing methods have long involved the packaging of foodstuffs and similar perishable items in clear plastics bags or film wrapping. There is a current trend towards the display of non-perishable items, such as clothing in similar packaging or wrapping. The advantages to the retailer are many. In particular, if an item offered for purchase on a counter or display stand is likely to be handled by the general public several times before purchase of a particular item occurs, the item could become soiled or rumpled if not protected in some way. The retailer may use the packaging or wrapping itself to convey more or less important information concerning the contents of the package, together with his trade mark.

Heretofor it has frequently been the practice for both perishable and non-perishable items to be packaged by hand. There is an evident need for a relatively simple, small and inexpensive machine which would enable the automatic or semi-automatic packaging of items close to the point of sale.

There is described and claimed in British Patent Specification No. 1518506 continuous roll stationery formed of a plastics material and comprising a series of envelopes each separated from its respective neighbour(s) in said roll by a tear-line allowing detachment of the envelope from the continuous roll; each envelope being open for insertion of mail thereinto and being arranged for closure by a sender, and also being arranged for subsequent opening and removal of mail therefrom by a recipient; and at least a portion of the surface of each envelope being adapted to receive an address, however written, and to allow postage stamps to be attached.

The present invention has arisen from a desire to provide a form of apparatus which may be embodied as apparatus for bagging items for sale or display, or as mailing office machinery for inserting correspondence or the like into envelopes.

STATEMENT OF THE INVENTION

According to one aspect of the present invention, there is provided apparatus for handling bags or envelopes, comprising: means for mounting a continuous length supply of bags or envelopes comprising a series of bags or envelopes each separated from its respective neighbour(s) by a tear-line allowing detachment of the leading endmost bag or envelope from the continuous length supply, each bag or envelope being open at or adjacent one marginal edge of the continuous length supply for insertion thereinto of an item to be bagged or correspondence or the like; means for advancing the free end of the continuous length supply; suction means for holding the leading endmost bag or envelope of the supply in a predetermined position or orientation; and blowing means for directing a stream of air towards the opening of said endmost bag or envelope while held by the suction means, and into the said bag or envelope to thereby hold the same open for the insertion of an item to be bagged or correspondence or the like.

In a second or alternative aspect, this invention provides a method of filling a bag with an item to be packaged or an envelope with correspondence or the like, the method comprising: drawing the leading endmost bag or envelope from a continuous length supply comprising a series of bags or envelopes each separated from its respective neighbour(s) by a tear-line allowing detachment of the leading endmost bag or envelope from the continuous length supply, each bag or envelope being open at or adjacent one marginal edge of the continuous length supply for the insertion thereinto of an item to be bagged, or correspondence or the like; holding the said leading endmost bag or envelope in a predetermined position or orientation by applying suction to one side thereof; and inserting the said item or correspondence or the like into the open mouth of said leading endmost bag or envelope as the same is held open by blowing air thereinto while the said leading endmost bag or envelope is held by said suction.

A single fan means may constitute both the suction means and the blowing means and, as will be explained in more detail below, in the preferred arrangement, the apparatus may be operated semi-automatically by means of a photoelectric cell which senses the passage of so-called "eye"-marks on the bags or envelopes. The endmost bag or envelope may be held in position on a conveyor belt provided with a plurality of suction apertures, the movement of which conveyor belt is controlled in sync with operation of the fan and of a solenoid-controlled clamping bar which is controlled to clamp the leading edge of the nextmost bag or envelope of the supply so that when the endmost bag or envelope is filled, it may be detached from the remainder of the supply by tearing along the tear-line adjacent the clamp.

The continuous length supply may consist of a continuous roll of said bags or envelopes. Alternatively, the continuous roll supply may comprise a stack of bags or envelopes each separated from its respective neighbours by a tear-line allowing detachment of the leading endmost bag or envelope from the free end of the supply, the stack being folded in fanfold fashion along the tear-lines.

DESCRIPTION OF THE PREFERRED EMBODIMENTS

Figure 1:
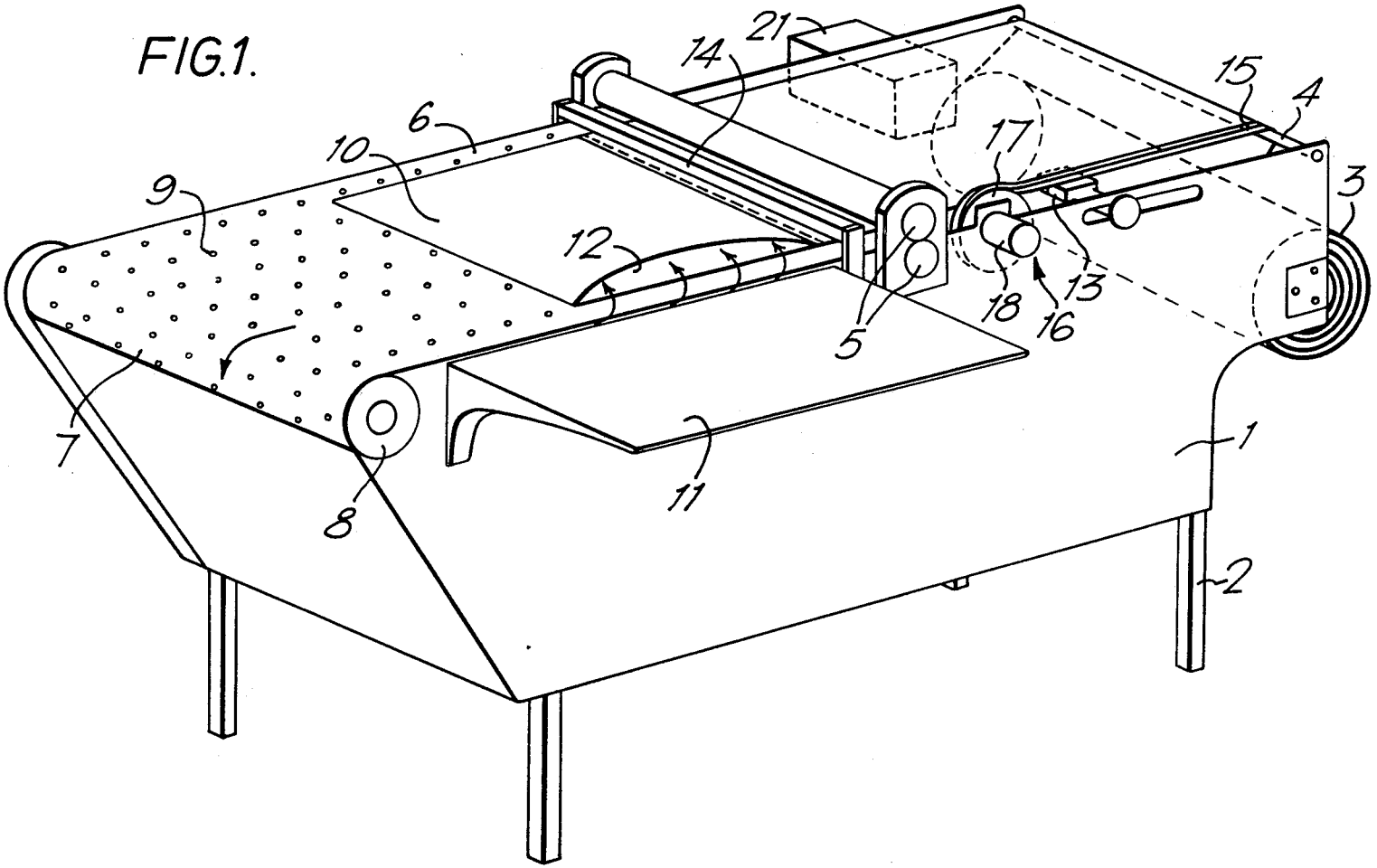
FIG. 1 shows a somewhat schematic overall perspective view of an embodiment of apparatus constructed in accordance with the present invention.

The apparatus illustrated in FIG. 1 comprises a housing 1 supported from the floor or from a tabletop on four legs 2. A supply 3 of flexible fillable containers—that is: performed bags or envelopes—in the form of a continuous length comprising a series of the bags or envelopes each separated from its respective neighbours by a tear-line allowing detachment of the leading endmost bag or envelope from the continuous length supply is mounted at one end of the housing. The continuous length supply here consists of a continuous roll mounted for rotation about its axis with the free end of the roll passing over a location rod 4 and then along the top of the machine through the nip between a pair of rollers 5, and thence on to a flat surface 6.

Figure 3:
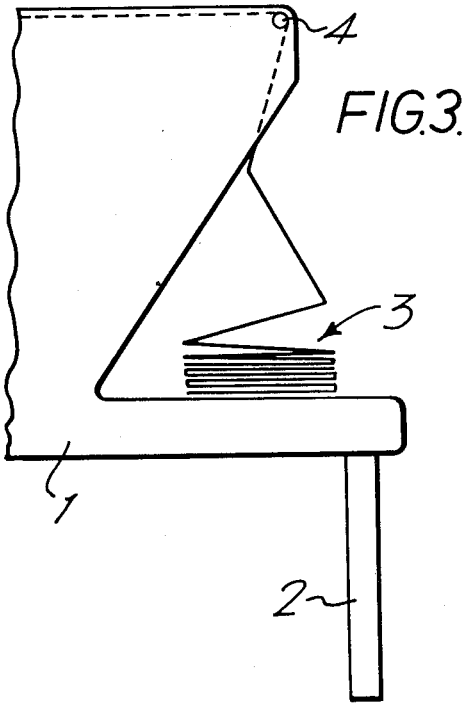
FIG. 3 shows a partial side elevational view of a modified version of the apparatus of FIG. 1.

The continuous length supply may take other forms. A particularly useful form for such supply comprises (as shown in FIG. 3) a stack of bags or envelopes each separated from its respective neighbours by a tear-line allowing detachment of the leading endmost bag or envelope from the free end of the supply, the stack being folded in fanfold fashion along the tear-lines. This arrangement takes up a minimum of space and reduces the possibility of damage to the bags or envelopes since (unlike in a roll) they are not under tension.

Referring again to FIG. 1, the flat surface 6 comprises, in this embodiment, a conveyor belt 7 adapted to move intermittently in the direction shown by the arrow. In the view of FIG. 1, only the conveyor roller 8 at the end of its feed reach is visible; it is to be understood that there will be a similar roller at the beginning of the feed reach and that the conveyor belt 7 will have a similar return reach not shown. It would be feasible for the lowermost of the rollers 5 to serve as the second conveyor roller.

Figure 4:
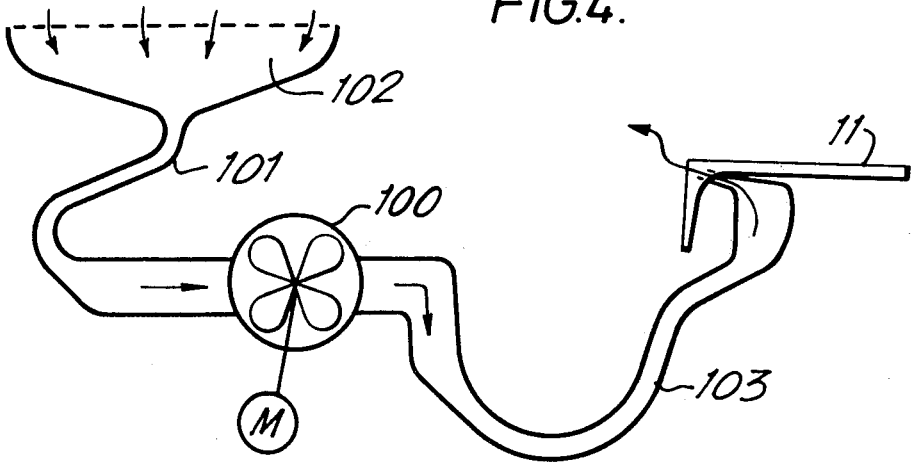
FIG. 4 is a schematic drawing of the suction and blowing means of the apparatus of FIG. 1.

At all events, the flat surface 6 has a plurality of apertures 9. Mounted within housing 1 is a fan 100 and ducting 101 (see FIG. 4) open adjacent the underside of flat surface 6. The precise specification for the fan and the form of the ducting is not of any great significance, but the arrangement must be effective such that when the fan is operative a partial vacuum is created on the underside of the flat surface 6 creating a suction effect tending to draw anything placed upon the surface 6 downward thereagainst. Suction airbox 102 at the end of ducting 101 suitably extends beneath the greater part of the flat surface 6. Thus, when the endmost bag or envelope 10 from roll 3 is located on that surface 6 and the suction is applied, the said bag or envelope will be held firmly against the flat surface in a predetermined position. Since, in the illustrated embodiment, the flat surface 6 forms part of a conveyor belt, it would be possible (though it is not so preferred) for the suction to be applied while the belt is still moving so that the bag or envelope 10 in this condition may be said to be held in a predetermined orientation if not in a predetermined position.

Mounted from the housing 1 alongside the flat surface 6 is a table 11 which is conveniently positioned for the operator to place thereon, ready for insertion into the bag or envelope as the case may be, the item to be bagged or the correspondence or the like to be mailed. Ducting 103 (see FIG. 4) from the fan opens immediately beneath the table 11 so that, at the same time as a suction is applied through the aperture 9 upon the endmost bag or envelope 10, a stream of air is blown towards the adjacent marginal edge of the bag or envelope (as shown in FIG. 1). The bags or envelopes of continuous supply 3 are open at or adjacent this marginal edge so that the stream of air directed towards the marginal edge opens mouth 12 of bag or envelope 10 so that the item, or the correspondence or the like, may be readily inserted therein by hand.

A photo-electric cell 13 is adjustably mounted as shown for controlling the intermittent operation of the conveyor belt 7, the rollers 5, the fan, and a solenoid controlled clamping bar 14. As will be explained in more detail below with reference to FIG. 2 of the accompanying drawings, operation of the apparatus is synchronised by means of a suitable "eye"-mark on the bags or envelopes interrupting the light path of photo-electric cell 13 so that forward feed of a bag or envelope 10 onto the moving conveyor belt 7 is halted just after the tear-line separating the bag 10 from its neighbour has passed the clamping bar. In other words, the clamping bar is operated to hold the leading edge of the next following bag or envelope. Consequently, when bag or envelope 10 has been filled, it may be closed if provided with a closure means such as those described in British Pat. No. 1518506 or in British Pat. No. 1518505 both granted to D. C. Trethewy, one of the present inventors, which closure means may apply whether the bag is a plain plastic bag or a mailing envelope in accordance with the aforesaid patents, and may then be torn away from its neighbour.

The bags or envelopes are most suitably of the self-seal type having a pressure sensitive adhesive strip provided on the face thereof adjacent the respective openings of the bags or envelopes and protected from inadvertant adhesion to the continuous length supply by a protective strip 15. When such self-sealed bags or envelopes are employed in the apparatus, the apparatus suitably incorporates an attachment generally indicated 16 in FIG. 1 which is adapted to wind the protective strip onto a spool 17 as the continuous length supply is advanced. With the adhesive exposed, a flap formed adjacent the opening of the bag or envelope may be closed into confronting sealing relation with the pressure sensitive adhesive after filling of the bag or envelope. Winding spool 17 is suitably coupled to a winding motor 18 adapted to operate under restricted amperage, whereby to stall, ensuring that the protective strip 15 is held in tension and is wound onto the spool 17 as and when the continuous length supply is advanced.

Figure 2:
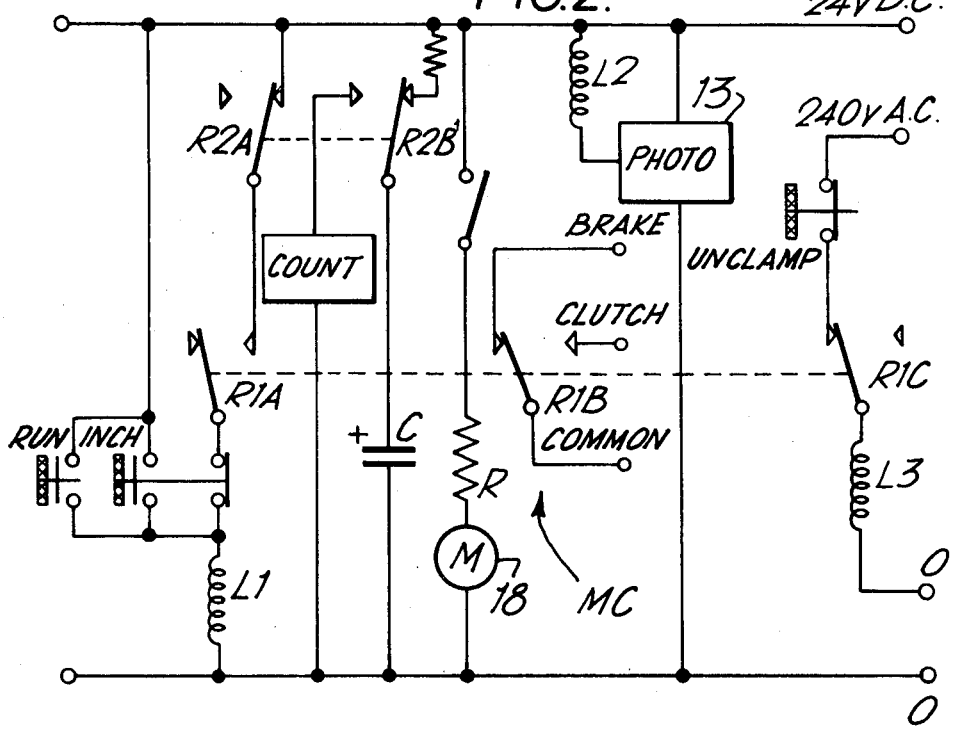
FIG. 2 shows a schematic circuit diagram for controlling the apparatus of FIG. 1.

Referring now to FIG. 2 which shows the control circuitry for the apparatus shown in FIG. 1, it will be noted that a separate motor circuit MC and clamp circuit, each driven directly from the mains alternating voltage are provided. The alternating voltage is transformed and rectified to a 24 volt direct current voltage for the main control circuit and for driving the winding motor 18 via a current limiting resistor R. The circuits include a first relay controlled by a first inductor L1 which relay includes three switches R1A, R1B and R1C respectively in the main control circuit, the motor circuit and the clamp circuit, and a second relay controlled by an inductor L2 and which includes two switches R2A and R2B, both of which are included in the main control circuit. Three control buttons, namely an "inch" button, a "run" button and an "unclamp" button are provided for purposes to be explained. The circuit includes a counter indicating how many bags or envelopes have been run through the machine and the photo-electric cell 13.

The circuit operates as follows: when inductor L1 is energized, its associated switches R1A, R1B and R1C are moved to the right. Movement of switch R1B to the right disconnects the motor brake and operates its clutch, so setting the motor into movement causing the belt 7, and rollers 5 to operate. Movement of switch R1C to the right deenergizes inductor L3 which directly controls the clamping bar 14 so as to lift the same. The inch button operates in conventional fashion so that when pressed it energizes inductor L1, but as soon as it is released, the circuit is broken and each of the switches R1A, R1B and R1C is moved back to the left. When the "run" button is operated, inductor L1 is energized to move each of the switches R1A, R1B and R1C to the right. In this condition the circuit is completed via inductor L1, switch R1A and switch R2A so that the relay L1, R1A is latched on. With switch R1B and switch R1C over towards the right, the rollers 5 turn drawing the bags or envelopes forward off the roll 3, and the clamping bar 14 is inoperative so that the endmost bag or envelope 10 is moved forward onto the conveyor belt 7 which runs in sync with the rollers. When the photo-electric cell 13 senses the "eye"-mark on the next following bag or envelope, it makes the circuit through inductor L2 which is energized to cause switches R2A and R2B to move over to the left. Movement of switch R2A to the left disconnects the circuit through inductor L1 and when this inductor is de-energized, the several switches R1A, R1B and R1C return to the left disconnecting the drive to the motor so that the conveyor 7 and the rollers 5 are halted and also completing the clamping circuit energizing inductor L3 and causing the clamping bar to operate. The arrangement is such that the clamping bar moves down onto the leading edge of the next following bag or envelope leaving the leading bag or envelope located on the flat surface 6. Movement of switch R2B over towards the left discharges capacitor C through the counter which increases by 1. In this condition, the fan may be operated by a separate fan circuit to cause the suction and airstream mentioned previously to hold the bag or envelope 10 in position on flat surface 6 and to open its mouth 12, all as described above. Alternatively, the fan may be connected in the brake circuit portion of the motor circuit MC so that movement of the switch R1B over to the left automatically sets the fan into motion.

Figure 5:
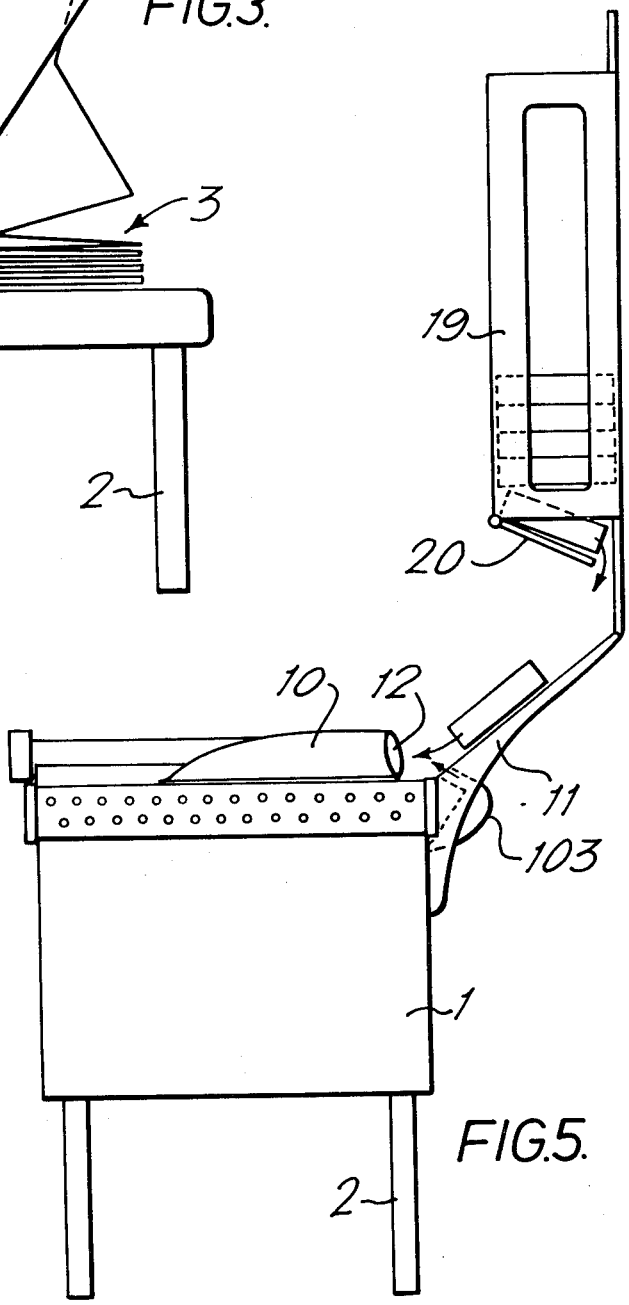
FIG. 5 is a front elevational view of an embodiment of apparatus incorporating an automatic hopper feed arrangement.

The table 11 may be arranged to slope downwardly (as shown in FIG. 5) to feed items, correspondence etc. into the open mouth 12 of a bag or envelope 10 and an automatic hopper arrangement 19 may be placed immediately above the sloping table 11 as shown. Such hopper 19 is suitably linked to the control circuit to operate in sync with advancement of the supply, as by including a further inductor in series with inductor L2 to energize a switch opening a trap-door 20 or similar arrangement to release an item, correspondence or the like for passage towards the open mouth 12 of a bag or envelope when such a bag is located in position. A similar arrangement may be employed for automatically switching on a separate fan circuit. A yet further inductor may be included in series with inductor L2 controlling a fan circuit time switch.

The apparatus particularly described above is extremely versatile in that one and the same machine may be used to package various items using the same continuous length supply. Additional flexibility is provided by the possibility of interchanging say one roll of preformed plastics bags with another roll in which the bags are of different dimensions. In modern retailing practice it is thought desirable, or in certain countries regulations may make it obligatory for a trade mark, a contents description, a price marking (either in figures or in terms of a bar code), or a "sell-by" date to be marked on the package. To avoid the necessity for a retailer or manufacturer having to carry stocks of different continuous length supplies pre-printed with trade mark, contents, price marking, "sell-by" date, etc., the present apparatus may incorporate (as indicated at 21 in FIG. 1) a suitable on-line printer. Suitable hot-foil printing machines are available from stock from various suppliers and can readily be incorporated in our apparatus for operation in sync with the advancement of the bags. It will be understood that in the particular position and orientation illustrated in FIG. 1, the printer 21 will print the underside of the bags as shown in that Figure. Other positions for the printer will readily occur to persons skilled in this field and are within the scope of this invention. Printer 21 may be controlled to operate in sync with the advancement of the supply of bags in exactly the same way as hopper arrangement 19 described above; that is: a yet further inductor may be connected in series with inductor L2 controlling a switch for a separate printer circuit.

The printer may be employed to print other appropriate information onto the continuous length supply. When the apparatus is employed for filling envelopes with mailing correspondence or the like, the printer may be employed to produce a pre-paid postage impression. The printer enables just so many of the bags or envelopes as appropriate to a particular run of the apparatus to be printed with the information concerned. The printer should be readily adaptable so that a variation of the said information may be printed on a succeeding run of the apparatus.

What is claimed is:

1. Apparatus for handling flexible fillable containers selected from the group consisting of preformed bags and envelopes, comprising:

means for mounting a continuous length supply consisting of a series of similar preformed flexible fillable containers, each separated from its respective neighbour(s) by a tear-line allowing detachment of the leading endmost such flexible fillable container from the continuous length supply, each such container being open at one marginal edge of the continuous length supply for insertion thereinto of a filling material;

means for intermittently advancing the free end of the continuous length supply;

a surface on which the flexible fillable containers are arranged to travel under control of said advancing means;

a filling station for said flexible fillable containers located at a predetermined location along said surface;

intermittently operable suction means located at said filling station for holding the leading endmost flexible fillable container of the supply in a predetermined position and selected orientation at said filling station;

intermittently operable blowing means for directing a stream of air towards the opening of the said endmost container while held by the suction means, and into the said container to thereby hold the same open for the insertion of a said filling material; and intermittently operable clamping bar means located immediately upstream of said filling station and adapted in operation to clamp the leading edge of the flexible fillable container next adjacent in said continuous supply to said endmost container at least for a period of time after filling of said endmost container is complete, thereby enabling ready detachment of the filled endmost container from said continuous supply along the tear-line separating said endmost and said next adjacent containers, to leave said filling station free for receipt of said next adjacent container.

2. Apparatus according to claim 1, wherein a single fan means together with appropriate ducting constitutes both the suction means and the blowing means.

3. An apparatus according to claim 1 or claim 2, further comprising a photoelectric cell positioned to sense the passage of "eye"-marks formed on the respective flexible fillable containers, and an electrical control circuit including the said photoelectric cell and adapted to control at least one of the suction means, the blowing means and the advancing means in accordance with the passage of an "eye"-mark past the said photoelectric cell, whereby the apparatus is adapted to operate semi-automatically.

4. Apparatus according to claim 1, wherein the suction means comprises a conveyor belt provided with a plurality of suction apertures, and means for creating a suction effect on one side of the said conveyor belt; said conveyor belt forming at least part of said surface, and the advancing means being operable to advance the free end of the supply to bring the leading endmost flexible fillable container of the continuous length supply into confronting relation with the other side of the said conveyor belt at said filling station; and wherein movement of the conveyor belt is controlled in sync with operation of the means for creating a suction effect and the blowing means.

5. Apparatus according to claim 1, wherein the blowing means includes ducting opening beneath a support surface on which a filling material may be located for insertion into the opening of the said endmost flexible fillable container while said container is held at said filling station by the suction means and held open by the stream of air issuing from the blowing means.

6. Apparatus according to claim 1, particularly adapted for use with flexible fillable containers of the self-seal type, being provided with a portion thereof defining a flap adjacent the said opening which flap is adapted to be brought into confronting relation with a strip of pressure sensitive adhesive provided on the face of the flexible fillable container adjacent the opening thereof, thereby to close the said container, the strip of pressure sensitive adhesive being protected from inadvertant adhesion to the continuous length supply by a protective strip; and wherein the apparatus includes a winding spool adapted to receive a continuous length of protective strip as such strip is removed to expose the pressure sensitive adhesive as the continuous length supply advances through the apparatus, the winding spool being coupled to a winding motor adapted to operate under restricted amperage, whereby to stall, ensuring that the protective strip is held in tension and is wound onto the spool as and when the continuous length supply is advanced.

7. Apparatus according to claim 1, further including a hot-foil printing machine adapted to operate in sync with the advancement of bags or envelopes through the apparatus for printing selected indicia onto the respective said bags or envelopes.

8. Apparatus according to claim 5, wherein the said support surface slopes downwardly for feeding said filling material into the openings of successive said endmost containers by gravity;

and wherein an automatic hopper arrangement is disposed above the said sloping support surface for delivering said filling material in sequence to the sloping support surface in sync with the advancement of the continuous length supply.

9. A method of filling a flexible fillable container selected from the group consisting of preformed bags and envelopes with a filling selected from the group consisting of items to be packaged, correspondence and like mailable material, the method comprising:

drawing a leading endmost preformed flexible fillable container of a continuous length supply over a surface to a filling station, said continuous length supply comprising a series of similar preformed such containers each separated from its respective neighbour(s) by a tear-line allowing detachment of the said leading endmost container from the continuous length supply, each such container being open at one marginal edge of the continuous length supply for the insertion thereinto of a said filling;

holding the said leading endmost flexible fillable container in a predetermined position and selected orientation at said filling station by applying suction to one side thereof;

inserting the said filling into the open mouth of said leading endmost container as the same is held open by blowing air thereinto while the said leading endmost container is held by said suction;

clamping the leading edge of the flexible fillable container next adjacent in said continuous supply to said endmost container at a position immediately upstream of said filling station at least for a period of time after said insertion is complete; and detaching the filled leading endmost container from said continuous supply along the tear-line separating said endmost and said next adjacent containers while the leading edge of said next adjacent container is so clamped.

10. A method according to claim 9, in which selected indicia is printed onto the appropriate number of respective said flexible fillable containers by means of a hot-foil printing machine operated in sync with the advancement of said containers.

11. A method according to claim 9, wherein the continuous length supply comprises a continuous roll.

12. A method according to claim 9, wherein the continuous length supply comprises a stack of similar said flexible fillable containers each separated from its respective neighbours by a tear-line allowing detachment of the leading endmost container from the free end of the supply, the stack being folded in fanfold fashion along the tear-lines.

13. A method according to claim 9, wherein a single fan provides both said suction and said blowing.

14. A method according to claim 13, wherein the respective bags or envelopes are provided with "eye"-marks thereon for passage past a photoelectric cell connected in an electrical control circuit for controlling operation of the fan.

15. A method according to claim 13, wherein the suction is applied through a plurality of suction apertures formed in a conveyor belt on which the leading endmost flexible fillable container is conveyed, movement of which conveyor belt is controlled in sync with operation of the fan.

16. A method according to claim 9, wherein the step of inserting the filling into the open mouth of said flexible fillable containers at said filling station is achieved by operating an automatic hopper arrangement provided with a sloping discharge path into said open mouth, the hopper arrangement being operated in sync with the advancement of the continuous length supply.

17. A method according to claim 9, wherein the flexible fillable containers are of the self-sealed type having a pressure sensitive adhesive strip provided on the face thereof adjacent the respective openings of the said containers protected from inadvertant adhesion to the continuous length supply by a protective strip;

and wherein the protective strip is wound onto a spool as the continuous length supply is advanced, enabling a flap adjacent the opening of the leading endmost said container to be closed into confronting sealing relation with the pressure sensitive adhesive after filling of the said container.

* * * * *